US012709817B2

(12) United States Patent
Ma et al.

(10) Patent No.: US 12,709,817 B2
(45) Date of Patent: Aug. 18, 2026

(54) HIGH DENSITY AND ADHESION COATING PROCESS AND COATINGS FORMED THEREBY

(71) Applicant: METAL IMPROVEMENT COMPANY, LLC, Paramus, NJ (US)

(72) Inventors: Xinqing Ma, Willington, CT (US); Robin Francis, Cambridge (GB); Peter F. Ruggiero, Westerly, RI (US)

(73) Assignee: METAL IMPROVEMENT COMPANY, LLC, Paramus, NJ (US)

( * ) Notice: Subject to any disclaimer, the term of this patent is extended or adjusted under 35 U.S.C. 154(b) by 187 days.

(21) Appl. No.: 18/375,161

(22) Filed: Sep. 29, 2023

(65) Prior Publication Data

US 2025/0109518 A1 Apr. 3, 2025

(51) Int. Cl.

| | |
|---|---|
| ***C25D 11/02*** | (2006.01) |
| ***C23C 4/06*** | (2016.01) |
| ***C23C 4/10*** | (2016.01) |
| ***C23C 4/129*** | (2016.01) |
| ***C23C 4/134*** | (2016.01) |
| ***C23C 4/18*** | (2006.01) |
| ***C23C 28/04*** | (2006.01) |
| ***C25D 11/04*** | (2006.01) |
| ***C25D 11/34*** | (2006.01) |

(52) U.S. Cl.

CPC ..... *C25D 11/026* (2013.01); *C23C 4/18* (2013.01); *C23C 28/04* (2013.01); *C25D 11/04* (2013.01); *C25D 11/34* (2013.01); *C23C 4/06* (2013.01); *C23C 4/10* (2013.01); *C23C 4/129* (2016.01); *C23C 4/134* (2016.01); *C23C 28/042* (2013.01)

(58) Field of Classification Search

CPC ..... C25D 11/026; C23C 28/042; C23C 4/18

See application file for complete search history.

(56) References Cited

U.S. PATENT DOCUMENTS 7,291,566 B2 11/2007 Escher et al.
7,560,376 B2 7/2009 Escher et al.
(Continued)

FOREIGN PATENT DOCUMENTS

KR 100798415 B1 * 1/2008 ..... C23C 4/134
RU 2218454 C2 * 12/2003 ..... C23C 28/044

OTHER PUBLICATIONS

Machine translation of RU2218454C2 of Kharlova. (Year: 2003).*
(Continued)

*Primary Examiner* — Brian W Cohen
(74) *Attorney, Agent, or Firm* — Howson & Howson LLP

(57) ABSTRACT

A process of applying a coating to a substrate is provided. A layer of a metallic or ceramic material is applied on the substrate by a thermal spray process. The layer is then subject to plasma electrolytic oxidation (PEO) processing to densify the layer such that a porosity of the layer after PEO processing is lower than a porosity of the layer before PEO processing, or modify the layer by incorporating additional ceramic phases from the electrolyte bath into the densified layer, or improve the adhesion of the thermal spray layer. A base layer may be applied to the substrate with PEO processing before the above referenced layer is applied and/or a ceramic topcoat may be applied to the above referenced layer by a thermal spray process.

18 Claims, 4 Drawing Sheets

(56) References Cited

U.S. PATENT DOCUMENTS

| | | | | |
|---|---|---|---|---|
| 8,293,335 | B2 * | 10/2012 | Chang | C04B 41/009 427/454 |
| 9,123,651 | B2 | 9/2015 | Shih et al. | |
| 9,546,432 | B2 | 1/2017 | Shih et al. | |
| 10,077,717 | B2 * | 9/2018 | Shmyreva | F16H 57/02 |
| 10,213,000 | B2 | 2/2019 | Moore et al. | |
| 10,871,256 | B2 | 12/2020 | Lu et al. | |
| 11,191,335 | B2 | 12/2021 | Moore et al. | |
| 2009/0317656 | A1 * | 12/2009 | Dai | C25D 11/04 205/107 |
| 2016/0326624 | A1 * | 11/2016 | Kang | C23C 4/126 |
| 2016/0376690 | A1 | 12/2016 | Wang et al. | |

OTHER PUBLICATIONS

Machine translation of KR100798415B1 of Kang et al (Year: 2008).*

A. Lopez-Ortega et al., "Corrosion, wear and tribocorrosion performance of a thermally sprayed aluminum coating modified by plasma electrolytic oxidation technique for offshore submerged components protection", Corrosion Science, No. 143, pp. 258-280, Aug. 2018.

Yuqin Rao et al., "On the PEO Treatment of cold sprayed 7075 aluminum alloy and its effects on mechanical, corrosion and dry sliding wear performances thereof", Surface & Coatings Technology, No. 383, Dec. 2019.

Selvakumaran Thunaipragasam et al., Investigation of Mechanical Behavior and Surface Characteristics of Cold Spray Metallized B4C/AA7075 Composites Coated by AZ64 alloy through Plasma Electrolytic Oxidation.

* cited by examiner

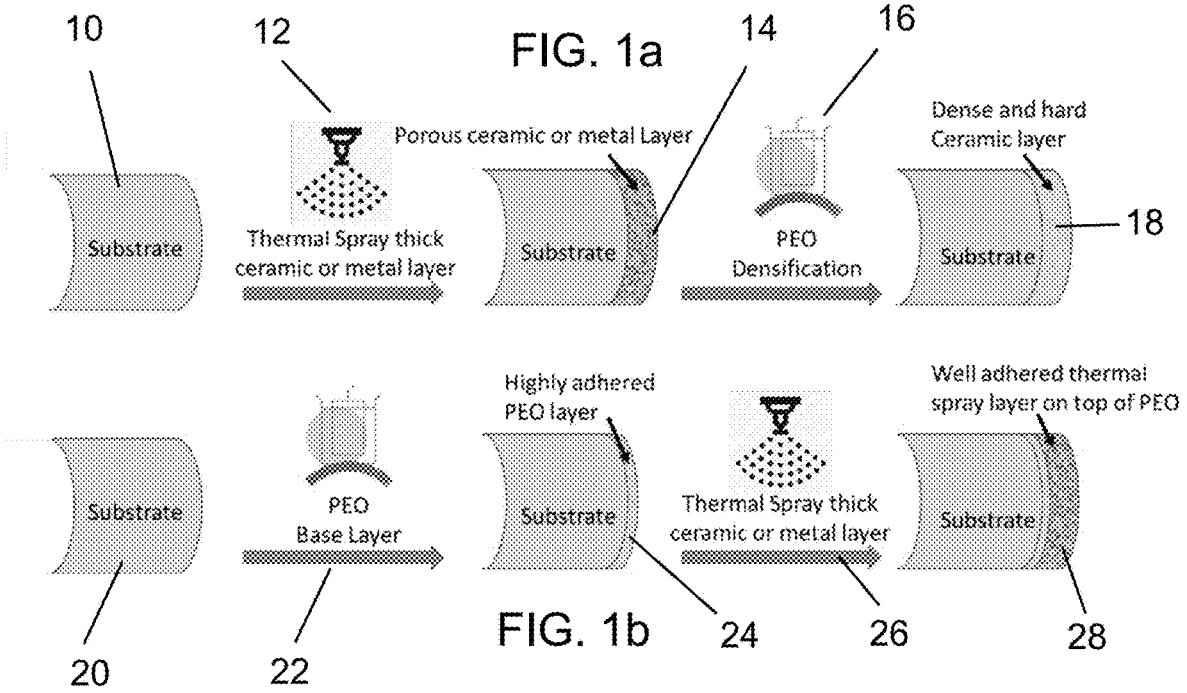
FIG. 1a
FIG. 1b
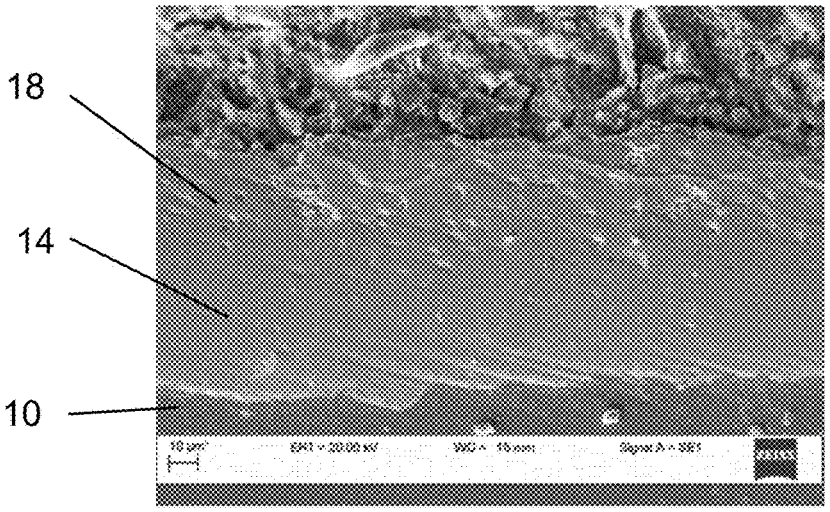
FIG. 2

| | TS | TS+PEO |
|---|---|---|
| Porosity * | 4.244% | 3.099% |
| Hardness (HK, load = 0.24517mN) | 886 | 1271 |

* Porosity measured via optical image analysis of cross-sectional SEM images.

HIGH DENSITY AND ADHESION COATING PROCESS AND COATINGS FORMED THEREBY

BACKGROUND

The present invention relates to a process for producing ceramic coatings having desired properties. In particular, the present invention relates to the production of coatings using a multi-stage process in which a combination of different coating techniques is applied sequentially to produce coatings with properties that are impossible or difficult to achieve using individual techniques alone and/or at a lower cost.

Plasma electrolytic oxidation (PEO) coatings on metals such as aluminum, magnesium, titanium, yttrium, tantalum, zirconium and zinc are known and used in numerous applications due to their chemical inertness, durability and high dielectric strength amongst other useful properties. PEO coatings are formed via a variety of complex physiochemical processes that occur during plasma discharges on the surfaces of articles to be coated during the process. These plasma discharges are initiated when high potential differences are applied to the article while it is immersed in a suitable electrolyte solution bath. The physiochemical processes may include oxidation, chemical reaction, electrophoresis, thermal decomposition, re-melting, densification, and precipitation.

Details of PEO coating processes and related equipment are disclosed in the following references: WO 99/31303 A1, WO 03/083181 A2, WO 2010/112914 A1, WO 2015/008064 A2 and WO2017/216577 A1, the disclosures of which are herein incorporated by reference.

As an example of a different coating technique, thermal spray (TS) coatings are used to apply metal, ceramic, and composite coatings to a wide variety of substrate types. In the TS process, melted or partially melted materials are accelerated towards the article to be coated. On impact, the particles created in this manner deform, flatten and are solidified to form an adhered solid-state deposit. Numerous such deposits accumulate to form the overall coating. There are several different variants of the TS process. Some of the most common are wire arc spraying, flame spraying, plasma spraying and high velocity oxy-fuel spraying (HVOF), as well as suspension thermal spray, solution precursor thermal spray and cold spray.

Plasma electrolytic oxidation (PEO) coatings excel at delivering ultra-high hardness, high dielectric strength coatings, with excellent adhesion to the substrate. PEO coatings are usually comprised principally of the oxides of the substrate material. By employing suitable electrolytes and processing conditions it is possible to incorporate other species such as silicates and phosphates into the coatings. However, the degree of compositional control is limited. Further, the substrate materials that can be processed is restricted to a relatively small number of metal alloys. In particular, commonly used materials such as ferrous and nickel containing alloys are not readily processed by PEO, while electrically non-conductive materials such as carbon fibre composites or glasses cannot be processed at all. Additionally, obtaining thick PEO layers, such as layers having a thickness of greater than 100 μm, can be difficult and/or expensive to achieve.

By contrast, thermal spray (TS) can coat thick layers over large surface areas easily. Further TS is extremely flexible both with respect to the materials that can be deposited, and the types of substrates that can be coated (encompassing all metals, composites, plastics, polymer, glasses and ceramics, etc.). However, adhesion of TS layers is generally lower than PEO, porosity is higher, and TS often perform less well on metrics such as hardness, adhesion, corrosion protection and wear resistance.

There is therefore a need for coating approaches that combine the best of both approaches—i.e., that combine the outstanding adhesion and materials properties of PEO coatings with the flexibility and rapid coating of TS approaches.

SUMMARY

According to an aspect of the present invention, a process of applying a coating to a substrate is provided. A layer of a metallic or ceramic material is applied on the substrate by a thermal spray process. The layer is then subject to plasma electrolytic oxidation (PEO) processing to densify the layer such that a porosity of the layer after PEO processing is lower than a porosity of the layer before PEO processing, or modify the layer by incorporating additional ceramic phases from the electrolyte bath into the densified layer, or improve the adhesion of the thermal spray layer.

According to another aspect of the present invention, a base layer is applied to the substrate with PEO processing before the above referenced layer is applied.

According to a further aspect of the present invention, a metallic or ceramic topcoat is applied to the above referenced layer by a thermal spray process.

BRIEF DESCRIPTION OF THE DRAWINGS

The foregoing and other objects, features and advantages of the embodiments disclosed herein should become apparent from the following description when taken in conjunction with the accompanying drawings.

FIG. 1*a* is a schematic view of an example of a substrate having a thermal sprayed coating subsequently subject to PEO processing, and FIG. 1*b* is an example of a substrate being subjected to PEO then subsequently having a thermal spray coating applied.

FIG. 2 is cross-sectional view of a substrate having a thermal sprayed coating subsequently subject to PEO processing.

DETAILED DESCRIPTION

Figure 3:
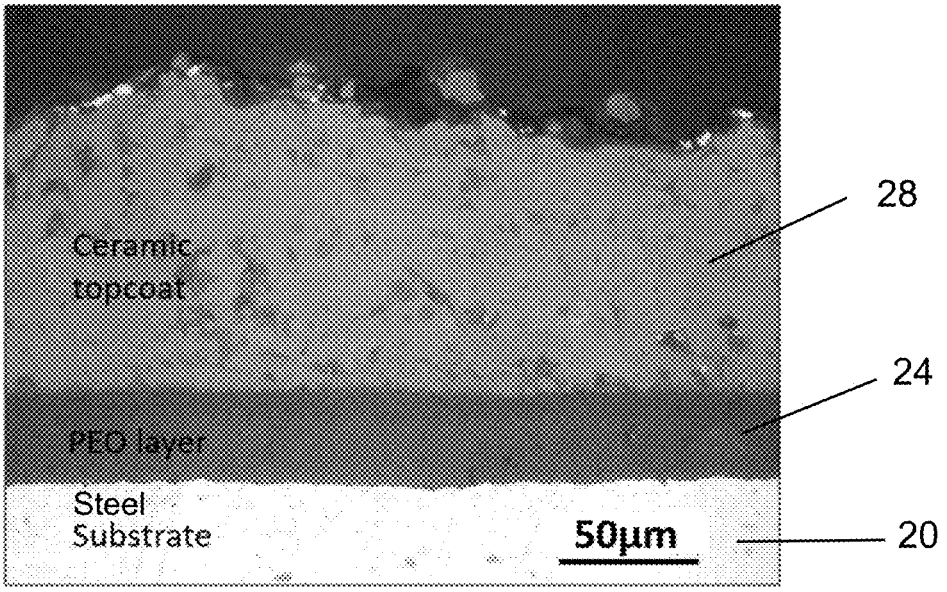
FIG. 3 is cross-sectional view of a substrate having a thermal sprayed ceramic coating subsequently deposited over a PEO layer.

For simplicity and illustrative purposes, the principles of the embodiments are described by referring mainly to examples thereof. In the following description, numerous specific details are set forth in order to provide a thorough understanding of the embodiments. It will be apparent however, to one of ordinary skill in the art, that the embodiments may be practiced without limitation to these specific details. In some instances, well known devices, apparatus, methods and structures have not been described in detail so as not to unnecessarily obscure the embodiments.

A PEO process can be used to convert a surface of a number of metals, such as aluminum, magnesium and titanium, but also metals such as zirconium, yttrium, zinc, tantalum and niobium, to a ceramic coating.

PEO coatings are characterized by a number of advantageous properties including exceptional adhesion, high hardness, high thermal and chemical stability, corrosion resistance, and high dielectric strength. They are utilized for applications such as wear protection, corrosion protection, and inert barrier coatings in semi-conductor processing equipment. Some porosity is evident in the coatings which enables other applications such as photocatalysis, chemical catalysis, and osseointegration.

The PEO process proceeds via the formation of energetic discharges which can produce local temperatures of greater than 10,000° C. These discharges form bubbles of vaporized material. Subsequently, rapid collapse of the bubbles occurs due to the presence of cold electrolyte surrounding the article, causing condensation of metal compounds, ceramic phases and other chemical species. These processes occur on a rapid timescale, with bubble formation and collapse happening over a period of microseconds.

A large number of thermochemical reactions are occurring during this process including vaporization of the substrate, oxidation of the substrate, melting of previous formed coating, dissolution of species into the electrolyte, condensation of metal oxides, hydroxides and other species, and incorporation of materials from the electrolyte. When a bipolar waveform is applied, additional processes can occur during the cathodic half-cycle including partial or complete reduction of chemical species in the electrolyte or the coating, and precipitation of further phases from the electrolyte.

PEO coatings are typically comprised principally of oxides of the substrate materials. By using appropriate electrolytes, it is possible to incorporate other species in the coatings and alter the coating composition. For example, metal silicates and/or phosphates may be added to the electrolyte which may lead to the incorporation of silicates or phosphates in the coating. It will be appreciated by those skilled in the art that the range of possible electrolytes that can be used in PEO is large, and the current disclosure is without limit in terms of the other components of the electrolyte.

The ability to alter composition is not unlimited, however, and typically oxide phases of the substrate material will dominate due to the fundamental nature of the PEO process which involves discharge and vaporization at the substrate interface. This can be a limitation for some functional applications where specific compositions are preferred. Examples of those applications include yttria coatings for plasma erosion and corrosion resistance, ceria coatings for photocatalysis, and hydroxyapatite coatings for biocompatibility.

Another limitation of PEO is that only certain metals (often referred to in the literature as "valve" metals) are suitable for the process. Some commonly used materials such as ferrous metals and nickel superalloys are challenging to process via PEO and, if these metals are subjected to typical PEO conditions, poor quality coatings are formed.

PEO coatings are generally less than 100 μm thick, and are most typically 10-60 μm in thickness. While thicker coatings can be produced in some circumstances, they are usually highly porous and of low quality. The thickness of PEO coatings is fundamentally limited by the formation of a dielectric barrier as the coatings form. Eventually this dielectric layer becomes sufficiently electrically insulating that even the high potential differences employed in PEO do not cause dielectric breakdown, and the process ceases.

Electrolytes used in PEO are typically dilute alkaline aqueous solutions, for example alkali metal hydroxides in 0.5-10 g/L concentrations. However, other components are usually added to the electrolyte to modify the chemical composition and microstructure. For example, metal silicates and/or phosphates can be added to the electrolyte which may lead to the incorporation of silicates or phosphates in the coating.

A wide variety of substrates can be used including aluminum, magnesium, titanium, zirconium, niobium and tantalum or alloys thereof. However, commercial applications of PEO are dominated by aluminum, magnesium and titanium due to the attractive material properties of both the substrate and coatings formed thereon. Coatings on aluminum are used due to the low cost and wide use of aluminum and the high hardness and dielectric strength of aluminum oxide (particularly the alpha form often called corundum or sapphire). However, as noted above, some metals and alloys are not generally suitable for PEO including such commonly used materials as iron, steel, nickel alloys and brass.

In contrast to PEO coating techniques, thermal spray coatings are formed by heating and melting of powders of materials (feedstock) and accelerating them towards a substrate using a suitable device (usually described as a "gun"). The combination of heating and high-speed impact on the surface causes partial melting and plastic deformation of the particles causing them to spread over the surface. Millions of these impacts causes the entire surface to be covered in the material being sprayed. Variants of the thermal spray technique include flame spray, plasma spray, and high-velocity oxy-fuel (HVOF) spray.

Since essentially any type of feedstock materials (solid powder, wire, bar, liquid state suspension, or solution precursor, etc.) can be used in the thermal spray approach, the types of materials that can be sprayed is extremely wide, including metals, ceramics, carbides, composites and others. Further, almost any type of substrate can be coated including all metals, ceramics, composites, glasses and others.

An advantage of the thermal spray approach is that thick layers can be deposited rapidly over a wide area. Further, much thicker coatings can be deposited in comparison to PEO and other competing surface coating technologies such as physical and chemical vapor deposition (PVD/CVD).

Against these positive attributes, thermal spray does have a number of disadvantages. Thermal spray coatings tend to be quite porous which negatively impacts a number of properties including hardness and durability. Further, adhesion to the substrate is usually relatively poor since there is no strong chemical bonding between the substrate and coating. Further, thermal spray is a line-of-sight process which has limitations with respect to applying a coating on a substrate with interior features such as small holes, deep bores and cavitation.

There is therefore a need for a coating that combines the positive aspects of PEO and TS coatings while minimizing the negative aspects. According to embodiments, the use of a multi-stage process in which PEO and TS are applied sequentially (in either order) enables coatings to be produced having properties that are impossible or difficult to achieve using either process alone, and which are advantageous versus those produced via either technique alone. The embodiments utilize a process by which PEO and TS can be combined that display equivalent or better performance to coatings than those achievable by either alone, and which allows a wider range of both substrate types and coating composition than that previously achievable using PEO alone.

TS Process Followed by PEO Process

In a first embodiment as shown schematically in FIG. 1*a*, a substrate 10 is applied with and includes a coating. The coating may be formed by initial use of a thermal spray process 12 used to apply a metal or ceramic coating 14 to the substrate 10. Subsequently, a PEO process 16 is used to convert the TS applied layer 14 wholly or partially to a ceramic layer 18 (i.e., a PEO layer).

A cross-sectional view of a substrate 10 having a thermal spray layer 14 and subsequently subject to PEO processing 16 is shown in FIG. 2. In this embodiment, some of the thermal spray layer 14 remains after PEO processing. Thus, a PEO layer 18 is located on the thermal spray layer 14. In other examples, the entire thermal spray layer 14 may be converted to a PEO layer 18 (for instance, as shown schematically in FIG. 1*a*).

If the layer 14 is of metal, the metal applied is predominantly composed of a metal selected from the group of "valve" metals which are well suited to PEO, including aluminum, magnesium, titanium, yttrium, zinc, zirconium, tantalum, and niobium. The metal applied can also comprise a combination of these metals or metal matrix composites. Aluminum, aluminum alloys, and aluminum composites are particularly preferred due to the favorable properties of alumina containing ceramics, such as extreme hardness.

The subsequent PEO process converts the TS applied metal layer 14 to a ceramic coating 18. As with conventional PEO, the ceramic is principally composed of the oxide of the applied metallic layer 14, but can be modified using appropriate electrolyte additives. It will be appreciated that embodiments are without limits with respect to the PEO electrolytes used or the composition of the ceramic layer produced.

As discussed above, there is no limit to the types of material of the substrate 10 that the thermal spray technique 12 can be applied. However, for subsequent PEO processing 16, moderate or high electrical conductivity is required. Preferred types of substrates 10 include metals, metal matrix composites, and conductive ceramic composites. The combined thermal spray plus PEO process, 12 and 16, is not limited to use on articles made from metals and alloys that are conducive to PEO treatment. In particular, the above-described process can be applied to common metals, such as steels and nickel superalloys, that cannot usually be effectively coated using PEO. The embodiments therefore represent a generalized route to producing PEO coatings with favorable properties on any metallic substrate type. This dramatically increases the range of possible applications of PEO.

According to some embodiments, instead of the initial TS coating 14 being a substantially metal coating, the thermal spray process 12 may be used to produce a substantially ceramic coating 14 to the substrate 10. In this case, the subsequent PEO process is used to modify the composition, microstructure and physical properties of the initial ceramic layer 14. The second stage PEO process densifies and improves the properties of the ceramic layer 14, and improves adhesion leading to the formation of a dense ceramic layer 18 with the properties associated with PEO. Since the initial thermal spray process can coat higher thicknesses and large surface areas more rapidly than PEO, these embodiments represent a quicker and cheaper approach to the formation of thick coatings with the advantageous properties of PEO coatings on large surface area parts.

In addition, since the thermal spray process is without limit with regard to the composition of the deposited material, these embodiments represent a generalized route to incorporating functional ceramics into "PEO-like" coatings at a higher weight percentage than that achievable using PEO alone. Examples of such functional ceramics include alumina, zirconia (and yttria stabilized versions thereof), titania, yttria, and ceria. However, it will be appreciated that the embodiments disclosed herein are without limit with respect to the composition of the deposited ceramic.

The initial thermal spray deposition process 12 is also without limit with respect to the nature of the substrate 10. Since the deposited ceramic layer 14 acts as a passivation layer, this represents an alternative approach to producing coatings with the favorable properties associated with PEO on any metallic substrate type, including those that are not valve metals, such as steel or nickel.

PEO Process Followed by TS Process

According to a further embodiment as shown in FIG. 1*b*, a PEO process 22 is applied first to form a ceramic layer 24 on a metallic article or substrate 20 followed by a subsequent thermal spray process 26. Using appropriate electrolytes and process conditions the PEO coating 24 may have high roughness and porosity can be created which acts as an excellent "bond layer" for the subsequent thermal spray layer 28.

Such an embodiment has several significant advantages over conventional approaches. Firstly, the process negates the need to roughen (e.g., by sand blasting) and/or deposit an intermediate bond layer to ensure sufficient mechanical adhesion of the thermal spray layer 28 as with traditional processes. Secondly, since the adhesion of both the PEO layer 24 to the substrate 20 and of the PEO layer 24 to the TS layer 28 is extremely strong, the adhesive strength of the composite coating is higher than would be expected for a TS coating 28 alone. Thirdly, since the composition of the TS layer 28 is without limitation, the process combines the compositionally flexibility associated with TS with the exceptional properties of the underlying PEO layer 24, such as durability, chemical resistance, and conformal coating of complex geometries especially, with non-line-of-sight features such as small holes, deep bores and cavitation.

Examples of composite coatings include yttria and yttrium oxy-fluoride on alumina for plasma erosion resistance, zirconia on alumina for thermal barrier applications, and ceria on alumina for catalytic applications. However, it will be appreciated that the number of combinations is large and embodiments are without limit with respect to combination of ceramic applied by PEO and the material deposited by TS.

EXAMPLES

Embodiments are explained below based on the following Examples. These Examples are illustrative only, and the present invention is not limited based on the Examples.

Example 1

In this example, an aluminum layer is initially deposited by a thermal spray process on a substrate of stainless steel. Thereafter, this is then PEO processed to produce an aluminum oxide layer. Thus, in this example, the PEO process is used to electrochemically convert and densify the initially formed thermal sprayed metallic layer and thereby form an oxide ceramic composite layer.

The process conditions and resulting coating properties for Example 1 are as follows:

1st Coating process: HVOF thermal spray: Coating material: Al; HVOF system Jetkote 3000; working gases $O_2$ and $H_2$, flow rate: $O_2$ at 17 SCFH, $H_2$ at 41 SCFH; Standoff distance: 178 mm;

2nd post process: PEO to produce $Al_2O_3$ oxide composite (alkaline electrolyte, pH 11-14, bipolar waveform, V+450-650V, V− 150-350V);

Coating thickness: 5 to 100 μm, preferably 10-70 μm; most preferably 20-50 μm;

As-sprayed Coating porosity: 5-20%; after PEO process: <4% porosity;

Coating hardness: as-applied HV0.3=100-200; after PEO: 600-1800;

Oxide content in the modified PEO layer: 60-100%; and

Figure 4:
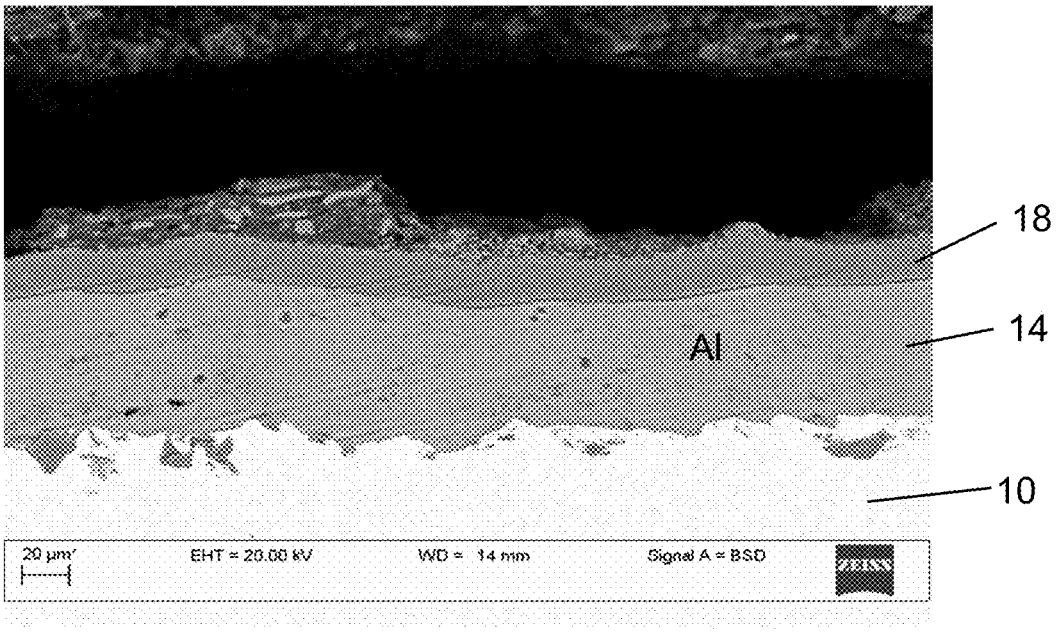
FIG. 4 is cross-sectional view of a substrate having a thermal sprayed aluminum coating subsequently treated into a PEO layer.

FIG. 4 is a cross-sectional view of a substrate having a thermal sprayed aluminum coating subsequently treated into a PEO layer.

Example 2

In this example, an yttrium oxide layer is initially deposited by thermal spray method on a substrate, then a PEO process is used to form a dense $Y_2O_3$ oxide layer (i.e., densification of a thermal sprayed ceramic layer by PEO).

The process conditions and resulting coating properties for Example 2 are as follows:

1st Coating process: atmospheric plasma spray; 7 MB gun system, Working gases Argon and hydrogen, Ar flow at 80 FMR, $H_2$ at 20 FMR, current: 600 A and voltage, 55 volts; spray distance: 76 mm;

2nd post process: PEO to densify the oxide layer (alkaline electrolyte containing yttrium salts, pH 11-14, bipolar waveform, V+450-650V, V− 150-350V);

Coating thickness: 5 to 100 μm, preferably 10-70 μm; most preferably 20-50 μm;

As-sprayed Coating porosity: 5-20%; after PEO process: <4% porosity;

Coating hardness: as-applied HV0.3=300-500; after PEO: 600-800; and

Figures 5, 6:
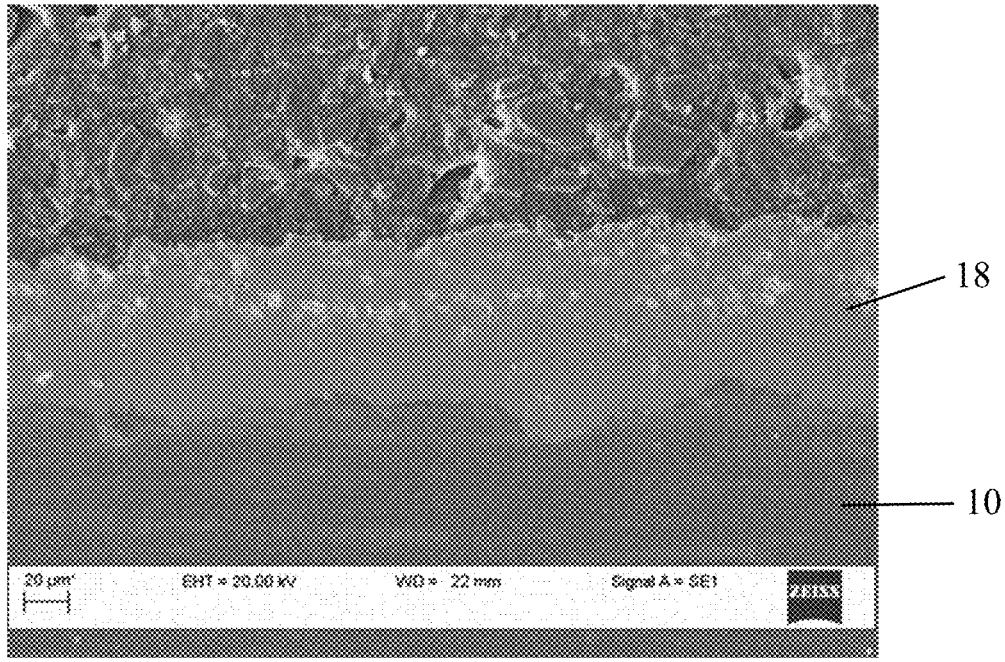
FIG. 5 is cross-sectional view of a substrate having a thermal sprayed ceramic coating subsequently treated by PEO process into a denser ceramic layer.
FIG. 6 is the results of coating porosity and microhardness HK0.25 of a substrate having a thermal sprayed ceramic coating treated without and with PEO process.

FIG. 5 is cross-sectional view of a substrate having a thermal sprayed ceramic coating subsequently treated by PEO process into a denser ceramic layer.

Example 3

In this example, an yttrium oxide layer is initially deposited by thermal spray method on a substrate. Thereafter, this layer is subject to PEO processing such that the thermal spray layer is densified and becomes a dense $Y_2O_3$ oxide layer with incorporated $Al_2O_3$ oxides therein (i.e., densified and modified $Y_2O_3$ layer with addition of $Al_2O_3$ from electrolyte of the PEO process).

The process conditions and resulting coating properties for Example 3 are as follows:

1st Coating process: atmospheric plasma spray; 7 MB gun system, Working gases Argon and hydrogen, Ar flow at 80 FMR, $H_2$ at 20 FMR, current: 600 A and voltage, 55 volts; spray distance: 76 mm;

2nd post process: PEO to densify and modify the $Y_2O_3$ oxide layer (alkaline electrolyte containing yttrium and/or aluminum salts, pH 11-14, bipolar waveform, V+450-650V, V− 150-350V);

Coating thickness: 5 to 100 μm, preferably 10-70 μm; most preferably 20-50 μm;

As-sprayed Coating porosity: 1-20%; after PEO process: <4% porosity;

Incorporated $Al_2O_3$ oxide content: 10-70 vol. %; preferably 20-60%; most preferably 30-50%;

Coating hardness: as-applied HV0.3=300-500; after PEO: 600-1200; and

FIG. 6 shows the results of coating porosity and microhardness HK0.25 of a substrate of this Example having a thermal sprayed ceramic coating treated without and with PEO process. As shown in the Table of FIG. 6, porosity is reduced from 4.244% to 3.099% and hardness is increased from 886 HK0.25 to 1271 HK0.25.

Example 4

In this example, the coating as described in Example 3 is then applied with a top layer of 8YSZ applied by thermal spray (i.e., the densified and modified $Y_2O_3$ layer of Example 3 is applied with a ceramic topcoat by thermal spray processing.

The process conditions and resulting coating properties for Example 3 are as follows:

Densified 1st Coating layer (see Example 3);

2nd ceramic layer of 8YSZ is applied over the densified 1st layer by thermal spray; and Topcoat Coating thickness: 100 to 300 μm.

Example 5

In this example, a PEO layer of $Al_2O_3$ layer is formed on the substrate of Example 3 prior to applying a zirconia ($ZrG_2$-8 wt. % $Y_2O_3$) or yttrium oxide layer deposited by thermal spray method. The PEO layer is applied to improve interface adhesion by CTE match and morphology for the subsequently applied ceramic layer.

The process conditions and resulting coating properties for Example 5 are as follows:

1st PEO layer ($Al_2O_3$) thickness: 5-50 μm, preferably 10-30 μm;

2nd layer ceramic layer applied by thermal spray (see Example 3);

3rd layer post process: PEO to densify and modify the oxide layer (see Example 3);

2nd layer Coating thickness: 5 to 100 μm, preferably 10-70 μm; most preferably 20-50 μm;

As-sprayed Coating porosity: 5-20%; after PEO process <4% porosity;

Incorporated $Al_2O_3$ oxide content: 10-70 vol. %; preferably 20-60%; most preferably 30-50%;

Coating hardness: as-applied HV0.3=300-500; after PEO: 600-1000;

A cross-sectional view of the substrate having a thermal sprayed coating subsequently deposited over a PEO layer is shown in FIG. 3.

Figure 7A:
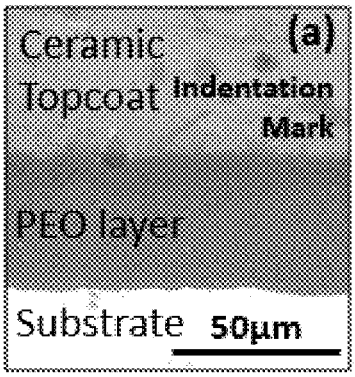
FIGS. 7*a*, 7*b*, and 7*c* are micro-indentation testings at the interface of the PEO/thermal sprayed ceramic top coating to indicate the improvement in coating adhesion and interface fracture toughness without cracking. Vickers Indentation load is 50 gram in FIG. 7*a*, 300 gram in FIG. 7*b*, and 500 gram in FIG. 7*c*.
Figure 7B:
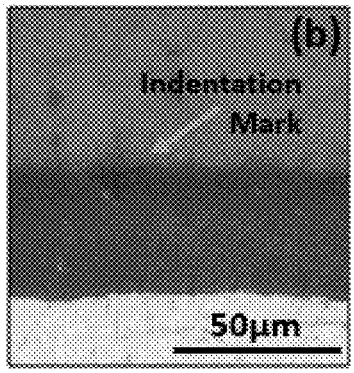
Figure 7C:
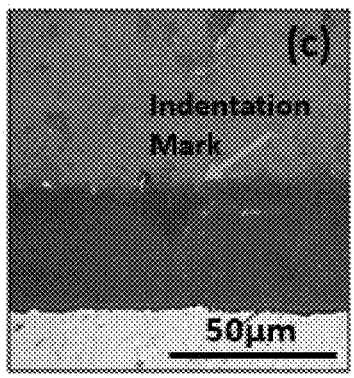

Micro-indentation testing was performed at the interface of the PEO/thermal sprayed ceramic top coating to indicate the improvement in coating adhesion and interface fracture toughness without cracking. As shown in FIGS. 7*a*, 7*b*, and 7*c*, Vickers Indentation load is: 50 gram in FIG. 7*a;* 300 gram in FIGS. 7*b* and 500 gram in FIG. 7*c*.

Additional Examples

As an additional example, an aluminum layer may be deposited by thermal spray method on a magnesium substrate. Thereafter, the aluminum layer may be subject to PEO processing to produce an aluminum oxide layer.

Alternatively, an aluminum oxide layer may be deposited by PEO processing on an aluminum alloy substrate. Thereafter, a zirconia ceramic layer may be applied over the PEO layer by a thermal spray process.

Still further, an aluminum oxide layer may be deposited by PEO on an aluminum alloy substrate. Thereafter, an yttrium oxide ceramic layer may be applied over the PEO layer by a thermal spray process.

The foregoing description and specific embodiments are merely illustrative of the principles thereof, and various modifications and additions may be made to the apparatus by those skilled in the art, without departing from the spirit and scope of this invention.

We claim:

1. A process of applying a coating to a substrate of electrical conductor, comprising the steps of:

applying a ceramic layer of ceramic material on the substrate by a thermal spray process selected from the group consisting of wire arc spraying, flame spraying, plasma spraying, and high velocity oxy-fuel spraying (HVOF); and subjecting the ceramic layer produced by the thermal spray process to plasma electrolytic oxidation (PEO) processing in a bath of an electrolyte solution to densify the ceramic layer produced by the thermal spray process throughout a full thickness of the ceramic layer and to improve adhesion of the ceramic layer to the substrate, wherein a porosity of the ceramic layer after the PEO processing is less than 4%.

2. A process of applying a coating to an electrically conductive substrate, comprising the steps of:

applying a base oxide layer on a surface of the substrate with a first plasma electrolytic oxidation (PEO) processing in a bath of an electrolyte solution;

applying a ceramic layer of ceramic material on the base oxide layer by a thermal spray process selected from the group consisting of wire arc spraying, flame spraying, plasma spraying, and high velocity oxy-fuel spraying (HVOF); and after the thermal spray process, subjecting the ceramic layer produced by the thermal spray process to second plasma electrolytic oxidation (PEO) processing in a bath of an electrolyte solution to densify the ceramic layer produced by the thermal spray process throughout a full thickness of the ceramic layer, wherein the porosity of the ceramic layer after the second PEO processing is less than 4%.

3. The process according to claim 1, further comprising a step of applying a ceramic topcoat by a thermal spray process after the PEO processing.

4. The process according to claim 1, wherein, during PEO processing, the electrolyte solution includes an additive that modifies the ceramic layer, wherein the additive is selected from a metal oxide, a metal silicate, and a metal phosphate.

5. The process according to claim 1, wherein the thermal spray process is a high velocity oxy-fuel (HVOF) or plasma spray thermal spray process.

6. The process according to claim 1, wherein, during the PEO processing, a bipolar waveform with an anodic voltage in the range 400-700V and a cathodic voltage in the range 50-300V is used.

7. The process according to claim 1, wherein the oxide content in the layer after PEO processing is 10 to 70 vol. %.

8. The process according to claim 1, wherein the hardness of the layer after PEO processing is HV0.3 600-1800.

9. The process according to claim 1, wherein the substrate is made of aluminum, magnesium, titanium, yttrium, zinc, zirconium, niobium, cerium, tantalum, or alloys thereof.

10. The process according to claim 1, wherein the ceramic layer comprises a compound including at least one of aluminum, magnesium, titanium, yttrium, zinc, zirconium, niobium, cerium, and tantalum.

11. The process according to according to claim 1, wherein, during the PEO processing, the electrolyte solution has a pH of 10-14.

12. The process according to claim 1, wherein the ceramic layer after the PEO processing comprises at least one of aluminum oxide, phases of silicate, or phases of phosphate.

13. The process according to claim 1, wherein the ceramic layer after the PEO processing has a surface roughness Ra of less than 2 microns.

14. The process according to claim 1, wherein a thickness of the ceramic layer is 5 to 100 μm.

15. The process according to claim 1, wherein the substrate is made of a metal, a metal matrix composite, or a conductive ceramic composite.

16. The process according to claim 1, wherein a base ceramic layer is formed on a surface of the substrate to improve adhesion of the ceramic layer to the substrate.

17. The process according to claim 16, wherein the base ceramic layer is produced as a result of said PEO processing of the ceramic layer.

18. The process according to claim 1, wherein, during said PEO processing of the ceramic layer, a ceramic layer produced by said PEO processing is formed on the densified ceramic layer formed by the thermal spray process.

* * * * *